US005944576A

United States Patent [19]

Nelson et al.

[11] Patent Number: 5,944,576

[45] Date of Patent: Aug. 31, 1999

[54] FORMABLE BALLOON STICK WITH CONCEALING CUP

[75] Inventors: David C. Nelson, 2727 N. Revere Rd., Akron, Ohio 44333; Bruce W. Walden, Toronto, Canada

[73] Assignee: David C. Nelson, Akron, Ohio

[21] Appl. No.: 09/106,555

[22] Filed: Jun. 29, 1998

[51] Int. Cl.[6] ..... A63H 27/10

[52] U.S. Cl. ..... 446/220; 446/222; 446/489

[58] Field of Search ..... 446/220, 221, 446/222, 223, 226, 489

[56] References Cited

U.S. PATENT DOCUMENTS

| | | | |
|---|---|---|---|
| 2,882,645 | 4/1959 | Stivers | 446/222 |
| 3,002,240 | 10/1961 | Laguerre . | |
| 3,041,766 | 7/1962 | Decamp . | |
| 4,589,854 | 5/1986 | Smith | 446/223 |
| 4,729,749 | 3/1988 | Milne | 446/222 |
| 4,837,059 | 6/1989 | Milne | 446/222 |
| 4,881,916 | 11/1989 | Houser | 446/222 |
| 4,895,545 | 1/1990 | Nelson | 446/222 |
| 5,389,030 | 2/1995 | Chapkis | 446/221 |

*Primary Examiner*—Robert A. Hafer
*Assistant Examiner*—Jeffrey D. Carlson
*Attorney, Agent, or Firm*—Renner, Kenner Greive, Bobak, Taylor & Weber

[57] ABSTRACT

A stick and cup assembly for receiving and securing a balloon includes an elongated stick with a cup maintained at one end thereof. The cup is formed integrally with the stick. A collar is slidingly received upon the stick for selective locking engagement with the cup for securing a balloon thereto. The stick is preferably formed of a composition of polyester and rubber such that the stick is capable of being manually formed into any desired configuration and which retains that configuration once so formed.

14 Claims, 2 Drawing Sheets

FORMABLE BALLOON STICK WITH CONCEALING CUP

TECHNICAL FIELD

The invention herein resides in the art of novelty devices and, more particularly, to such devices used in the novelty balloon industry. In that regard, the invention relates to sticks and cups adapted for receiving and displaying such balloons. Specifically, the invention relates to a combination of an integrally formed stick and cup wherein the stick is manually formable to achieve and maintain a desired shape.

BACKGROUND ART

In recent years, novelty balloons have become quite popular. Not only are they often employed at parties and celebrations, but they are also often used individually to convey a message or to entertain children. In the past, it has been known to simply tether balloons on strings for display and use. More recently, sticks have been used for that purpose. Known balloon sticks often have cups attached to the end thereof, the cups being configured to receive and maintain the mouth and neck of the balloon for appropriate display. Sticks used for this purpose are typically quite rigid, with moderate flexibility. However, the sticks have a "memory" such that they seek and maintain a normally straight posture despite any flexing which might be experienced during employment.

It has recently become popular to employ extremely small or miniature balloons to develop balloon bouquets—quite similar to floral bouquets, but where balloons are employed instead of flowers. In order to more closely replicate flowers, the balloons are received and maintained in cups which are secured to wires by floral tape or the like. The wires, typically of copper, aluminum or formable steel, are then bent, twisted and formed to a configuration which replicates a flower stem or the like. Oftentimes, the wire itself is either pre-coated with a coating of desired color, or completely wrapped with floral tape. The use of such structure and technique has provided balloon bouquets of novel appearance, replicating that of a floral bouquet, development of such floral bouquets is both time consuming and expensive. The artisan must first adhere the balloon cup to the wire and then conceal the wire as by the implementation of floral tape or the like. Moreover, the combination of the stick and cup constitutes a two piece unit, both requiring inventorying and handling, as well as manipulation when in use.

The prior art has employed sticks with loops at the end thereof for threadingly receiving a balloon which was subsequently supported by a collar which slid upon the stick to engage the balloon. Such structures have been found to be difficult to use and inefficient in achieving an attractive end product.

There is a need in the art for an integral combination stick and cup, wherein the stick is easily shaped or formed and which retains that shape or form thereafter. Indeed, there is a need in the art for such an integral combination in which the stick and cup are of a straight elongate nature at manufacture, facilitating shipping and handling, and which may be easily formed into any of numerous desired shapes at the point of use, and retain those shapes following delivery to the end user.

DISCLOSURE OF INVENTION

In light of the foregoing, it is a first aspect of the invention to provide a formable balloon stick and cup assembly which is of integral one-piece construction.

Another aspect of the invention is the provision of a formable balloon stick and cup assembly in which the cup is adapted to securedly engage the neck of a balloon.

Yet another aspect of the invention is the proven of a formable balloon stick and cup assembly in which the stick is easily formable and which retains the set form thereafter.

Yet an additional aspect of the invention is the provision of a formable balloon stick and cup assembly which is of a straight elongate nature at the point of manufacture and during shipping, but which is easily manipulated and configured into any of various shapes at the point of use.

Still a further aspect of the invention is the provision of a formable balloon stick and cup assembly which is safe to use around children.

Still another aspect of the invention is the provision of a formable balloon stick and cup assembly which is easy to manufacture and use with state of the art apparatus and techniques.

The foregoing and other aspects of the invention which will become apparent as the detailed description proceeds are achieved by a stick and cup assembly for receiving and securing a balloon, comprising: an elongated stick; a cup maintained at and end of said stick and integral therewith; a collar slidingly received upon said stick for selective locking engagement with said cup for securing a balloon therein; and wherein said stick is manually formable to receive and retain contours imparted thereto.

Additional aspects of the invention which will become apparent herein are attained by a stick and cup assembly for receiving and maintaining a balloon, comprising: a flexible stick adapted to be manually formed to select contours and retentive of such contours, once so formed; a cup integrally maintained at an end of said stick: and a collar slidingly received upon said stick and adapted for mating engagement with said cup.

BRIEF DESCRIPTION OF THE DRAWINGS

For a complete understanding of the objects, techniques and structure of the invention reference should be made to the following detailed description and accompanying drawings wherein.

BEST MODE FOR CARRYING OUT THE INVENTION

Figure 1:
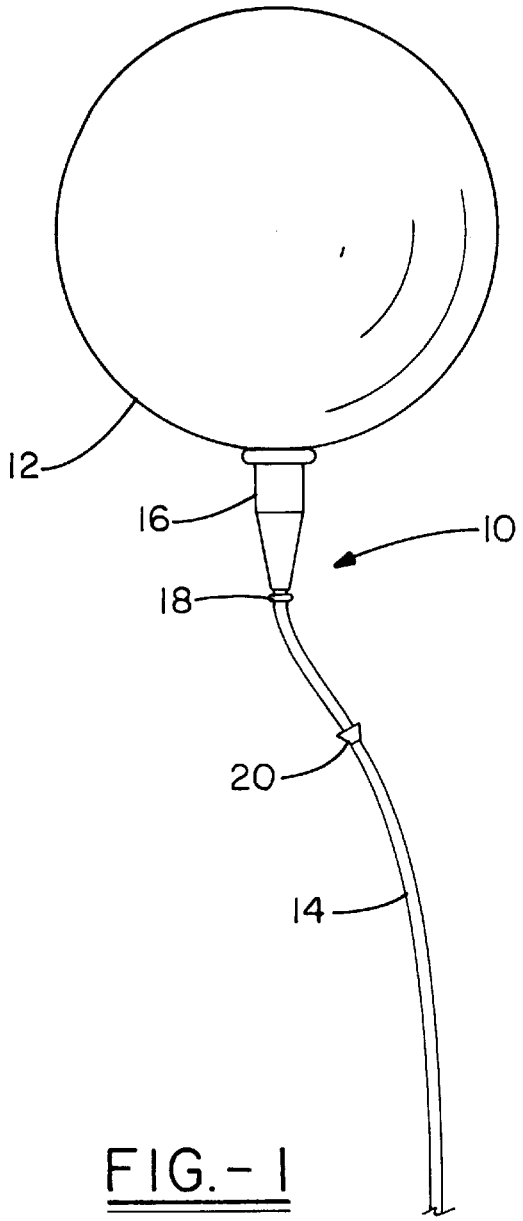
FIG. 1 is an illustrative view of the formable balloon stick and cup assembly according to the invention, in use with a balloon.

Referring now to the drawings and more particularly to FIG. 1, it can be seen that a balloon stick and cup assembly made in accordance with the invention is designated generally by the numeral 10. As illustrated in FIG. 1, the assembly 10 is adapted to receive a small balloon 12 at an end thereof. The balloon may be of either latex or foil construction and, in accordance with the invention, is typically of a diameter less than 7 inches, although the concept of the invention is applicable to a broad range of sizes. The assembly 10 includes a stick 14 twisted and formed to a curvate configuration for desired aesthetics. A collar 16, slidingly received upon the stick 14, is positioned at a top end of the stick 14 to securedly engage the neck or tail of the balloon 12 and orient the balloon at the end of the assembly 10. Most importantly, the collar 16 conceals the tail of the balloon 12 such that the balloon actually appears to "grow" from the stick 14. A circumferential flange 18, formed within the stick 14, retains the collar 16 in the position illustrated. Additionally, a shoulder 20 is formed within the stick 14 and is configured as an inverted cone so as to allow the collar 16 to pass thereover from the end of the stick 14 which does not receive the balloon 12, to the end which does. It will be appreciated that the shoulder 20 is configured to accomodate passage of the collar in a direction toward the balloon 12, but to restrict passage of the collar 16 in the opposite direction.

Figure 2:
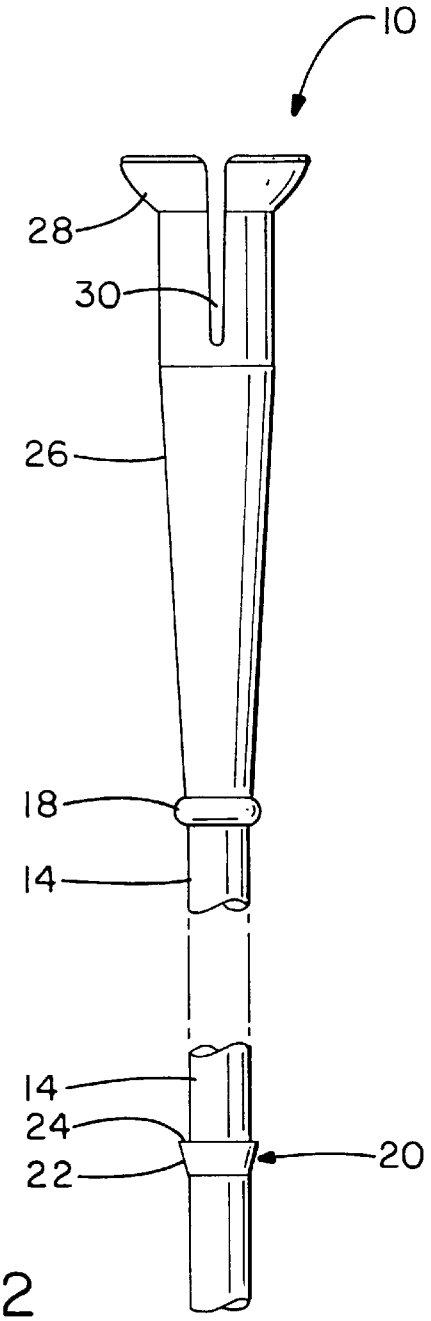
FIG. 2 is a side elevational view of the formable balloon stick and cup assembly according to the invention.

With reference now to FIG. 2, it can be seen that the shoulder 20 has a tapered body 22 which leads to an enlarged flat top 24. The tapered body 22 allows the hollow collar to deflect and slide thereover, with the enlarged flat top 24 serving as a restrictor or base to preclude its return.

As also shown in FIG. 2, a cup 26 is formed integrally with the stick 14 and positioned at the end thereof adapted for receiving the balloon 12. The cup 26 has a flared lip 28 at an outer end thereof, particularly flared and cup-shaped to receive the balloon 12 and support it in an upright vertical fashion. A pair of slots 30, diametrically opposed across the cup 26, and extending about a quarter of the depth thereof, are provided to receive the tail or neck of the balloon 12 in a twisted and interlocking fashion as is well known and understood by those skilled in the art. In other words, the balloon 12 is pulled by its tail into the flared lip 28 and the tail is lockingly interwoven between the slots 30 to secure the balloon into the flared lip 28.

As also shown in FIG. 2, the circumferential flange 18 is positioned at the bottom of the generally conically shaped cup 26. The flange 18 extends beyond the radius of the stick 14 and is rounded in its axial direction to accomodate passage thereover of collar 16, as will become apparent herein.

Figure 3:
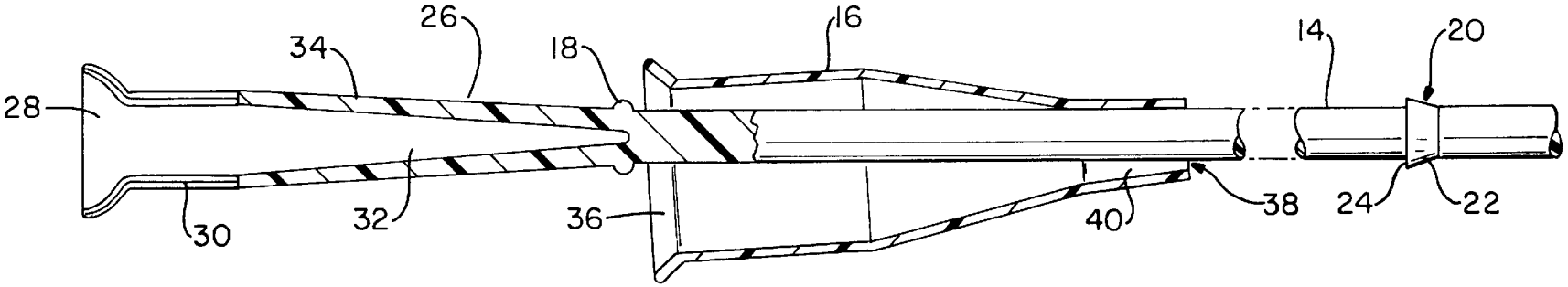
FIG. 3 is a cross sectional view of the formable balloon stick and cup assembly according to the invention, shown with the cup in its disengaged state.

With reference now to FIG. 3, it can be seen that the cavity 32 of the conical cup 26 is formed by a conical wall 34. The collar 16, also of a generally conical configuration, is slidingly received upon the stick 14 and is shown in FIG. 3 as positioned between the shoulder 20 and circumferential flange 18. As shown, the collar 16 has a flared lip 36 at an enlarged end thereof and an aperture 38 at the other. As shown, the aperture 38 provides a clearance between the collar 16 and the stick 14. The aperture 38 is provided in a necked down portion 40 of the collar 16.

It will be appreciated that collar 16 is positioned upon the stick 14 by passing it over the stick 14 opposite the end maintaining the cup 26. When collar 16 reaches the shoulder 20, the necked down portion 40 is deflected over the tapered body portion 22 such that the aperture 38 passes over the shoulder 20 and then recovers to its normal size immediately thereafter. The undeflected diameter of the aperture 38 is less than the diameter of the enlarged flat top 24, such that the collar 16 is now trapped between the shoulder 20 and the cup 26. This renders assembly 10 child safe, since the small collar cannot be easily removed from the assembly 10.

Figure 4:
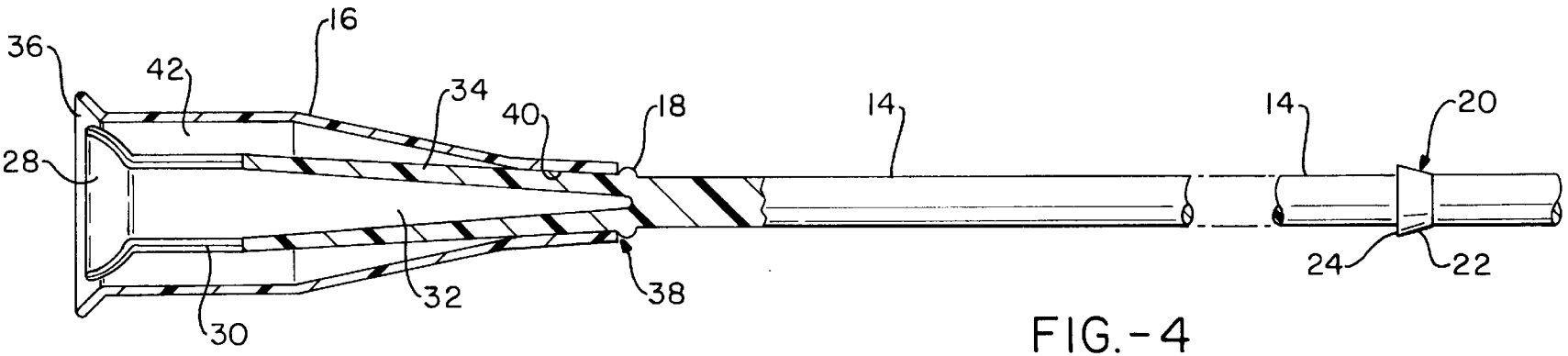
FIG. 4 is a cross sectional view of the formable balloon stick and cup assembly according to the invention, with the collar in its engaged securing position.

With reference now to FIG. 4, it can be seen that the collar 16 is adapted to be slid over the cup 26 and circumferential flange 18 for locking engagement, as illustrated. In use, with the balloon 12 received by the flared lip 28 of the cup 26 and the tail is wrapped about the top portion of the cup 26 near the slots 30, the collar 16 is slid over the circumferential flange 18 until the end of the aperture 38 passes thereover such that the flared lip 36 of the collar 16 also engages the balloon 12. The balloon is thus "cupped" in both the flared lip 28 of the cup 26 and the flared lip 36 of the collar 16. The neck or tail of the balloon is fully concealed and maintained within the annular space 42 between the collar 16 and the cup 26. Moreover, the collar 16 has compressed the conical wall 34 of the cup 26 since necked down portion 40 of the collar 16 has a smaller inner diameter than the corresponding outer diameter of the wall 32 immediately adjacent the circumferential flange 18. There is thus a springlike frictional engagement between the conical wall 34 and the necked down portion 40 of the collar 16 which is first maintained in place by the enlarged circumferential flange 18, having a diameter greater than that of the aperture 38.

It will be appreciated that the aperture 38 of the collar 16 must first deflect over the shoulder 20 and then over the circumferential flange 18, both having major diameters greater than the diameter of the aperture 38. Accordingly, the collar 16 is made of a flexible or deflectable material such as polyethylene, allowing the collar to pass thereover and deflect to a size large enough to do so, while immediately recovering after such passage to provide the desired locking engagement beyond the flange 18 and to further allow the shoulder 20 to serve as a gate or lock to inhibit removal of the collar 16.

As mentioned above with respect to FIG. 1, it is most desirable that the stick 14 be formable by hand manipulation and further be of such nature as to retain that form once a desired configuration has been attainted. In that regard, it has been found that if the stick 14 is made of a polystyrene with a small amount of rubber additive, the flexibility and retentive nature of the stick can be attained. In accordance with the invention, it has been found that the stick 14 is preferably made of a composite of styrene based material. In one embodiment of the invention, a composition of polystyrene and rubber is employed, where the rubber is 10–30% by weight of the composition. Alternatively, ABS (acrylonitrile butadiene styrene) may be employed, where the rubberized component of butadiene is on the order of 10–30% It will be appreciated that if the stick 14 were made solely of polystyrene, it would be akin to sticks previously known in the balloon industry, not being formable, but having a memory for total recovery to the original configuration. It is the addition of a substantial quantity of rubber to the polystyrene which allows the stick 14 to be both formable and retentive of its formed configuration.

A beneficial feature of the instant invention is the fact that the stick 14 and its integral cup 26 is molded as a straight elongated member. The separately molded collar is slid onto the stick 14 by deflecting passage over the shoulder 20. These straight assemblies are then bundled and shipped and stored in an effective and cost effective manner. Once at the place of use, however, the stick may be bent, twisted, shaped, or configured as desired. Once so formed, the stick 14 retains the desired configuration, subject to reconfiguration if desired.

It will be readily appreciated by those skilled in the art that a small latex or foil balloon may be inflated and nested into the flared lip 28 with the tail being lockingly woven into and through the slots 30. The remainder of the tail is simply wrapped about the area of the cup 26 at those slots. Once so positioned, the collar 16 is merely slipped over the circumferential flange 18 such that the necked down portion 14 of the collar 16 engages and compresses the conical wall 34 of the cup 26 until the aperture 38 has fully cleared the flange 18, at which time the balloon 12 is fully nested in the flared lips 28, 36 and the collar 16 is held in position by a combination of compressive engagement with the collar 16 and by the presence of the flange 18. The stick 14 may then be twisted, formed and configured in any desired manner for its end use.

Thus it can be seen that the objects of the invention have been satisfied by the structure presented above. While in accordance with the patent statutes only the best mode and preferred embodiment of the invention has been presented and described in detail, it will be appreciated that the invention is not limited thereto or thereby. Accordingly, for an appreciation of the true scope and breadth of the invention reference should be made to the following claims.

What is claimed is:

1. A stick and cup assembly for receiving and securing a balloon, comprising:

an elongated stick;

a cup maintained at and end of said stick and integral therewith;

a collar slidingly received upon said stick for selective locking engagement with said cup for securing a balloon therein;

a shoulder formed upon said stick, said shoulder retaining said collar upon said stick in said selective locking engagement with said cup; and wherein said stick is manually formable to receive and retain contours imparted thereto.

2. The stick and cup assembly according to claim 1, wherein said shoulder is cone shaped.

3. The stick and cup assembly according to claim 1, wherein said cup has a wall, said wall being split to receive a tail of a balloon received thereby.

4. The stick and cup assembly according to claim 3, wherein each of said cup and collar has a circumferentially flared lip about a rim thereof.

5. The stick and cup assembly according to claim 1, wherein said stick is formed of a polystyrene and rubber composition.

6. The stick and cup assembly according to claim 5, wherein said rubber comprises 10–30% by weight of said polystyrene and rubber composition.

7. A stick and cup assembly for receiving and maintaining a balloon, comprising:

a flexible stick adapted to be manually formed to selected contours and retentive of such contours, once so formed;

a cup integrally maintained at and end of said stick:

a collar slidingly received upon said stick and adapted for mating engagement with said cup; and wherein said stick has a circumferential flange adjacent said cup, said flange maintaining said collar in said mating engagement with said cup.

8. The stick and cup assembly according to claim 7, wherein said stick further has a shoulder thereon, said shoulder maintaining said collar upon said stick between said cup and said shoulder.

9. The stick and cup assembly according to claim 8, wherein said shoulder establishes a gate, allowing said collar to pass thereover toward said cup and preventing passage of said collar therewith away from said cup.

10. The stick and cup assembly according to claim 9, wherein said cup has a pair of slots in a wall thereof, said slots adapted to receive a tail of a balloon placed therein.

11. The stick and cup assembly according to claim 7, wherein said stick and cup are formed of a composition of polystyrene and rubber.

12. The stick and cup assembly according to claim 1, wherein said composition is 10–30% rubber, by weight.

13. The stick and cup assembly according to claim 7, wherein said stick and cup are formed of ABS.

14. The stick and cup assembly according to claim 13, wherein said ABS is 10–30% butadiene by weight.

* * * * *